US012729496B2

(12) United States Patent
Dacayanan Loya et al.

(10) Patent No.: US 12,729,496 B2
(45) Date of Patent: Sep. 8, 2026

(54) IMPACT NOSE WEDGE

(71) Applicant: Lindsay Transportation Solutions, LLC, Omaha, NE (US)

(72) Inventors: Daniel Paul Dacayanan Loya, Elk Grove, CA (US); Jason Lim, Rio Vista, CA (US); Matthew A. Elmore, Rio Vista, CA (US); John James Angus, Omaha, NE (US)

(73) Assignee: Lindsay Transportation Solutions, LLC, Omaha, NE (US)

( * ) Notice: Subject to any disclaimer, the term of this patent is extended or adjusted under 35 U.S.C. 154(b) by 455 days.

(21) Appl. No.: 18/520,773

(22) Filed: Nov. 28, 2023

(65) Prior Publication Data

US 2025/0171969 A1 May 29, 2025

(51) Int. Cl.
*E01F 15/14* (2006.01)

(52) U.S. Cl.
CPC ..... *E01F 15/143* (2013.01); *E01F 15/148* (2013.01)

(58) Field of Classification Search
CPC ..... E01F 15/143; E01F 15/148
USPC ..... 404/6
See application file for complete search history.

(56) References Cited

U.S. PATENT DOCUMENTS 5,217,318 A * 6/1993 Peppel ..... E01F 15/146 404/6
6,428,237 B1 8/2002 Duckett
7,722,284 B1 * 5/2010 Somwong ..... E01F 15/146 404/6
9,371,620 B2 * 6/2016 Rossmann ..... E01F 15/145
2005/0191125 A1 * 9/2005 Albritton ..... E01F 15/146 404/6
2011/0255916 A1 * 10/2011 Thompson ..... E01F 15/02 404/6
2012/0257925 A1 10/2012 Rigomer
2016/0060832 A1 * 3/2016 Alberson ..... E01F 15/08 404/6
2018/0127933 A1 5/2018 Maus et al.
2022/0213658 A1 7/2022 Margaritelli et al.

FOREIGN PATENT DOCUMENTS

KR 10-2007-0099909 A 10/2007

OTHER PUBLICATIONS

International Search Report and Written Opinion in related PCT Application PCT/US2024/056686 mailed Mar. 11, 2025, 11 pages.

* cited by examiner

*Primary Examiner* — Raymond W Addie
(74) *Attorney, Agent, or Firm* — HOVEY WILLIAMS LLP

(57) ABSTRACT

An anchorless crash cushion apparatus comprises a number of crash cushion elements and a nose assembly. The crash cushion elements are configured to be directly or indirectly connected end-to-end. The nose assembly is configured to be connected to one of the crash cushion elements and includes a forward component and a rearward component. The forward component includes a vertical section configured to engage the vehicle and a wedge incline extending diagonally upward toward the vertical section. The rearward component is configured to be driven upward by the wedge incline when the forward component is driven toward the rearward component by the vehicle.

20 Claims, 6 Drawing Sheets

IMPACT NOSE WEDGE

BACKGROUND

Traffic barrier systems are often placed on roadways to create barriers between opposing traffic lanes or between traffic lanes and roadside hazards. To that end, traffic barrier systems often include rigid barricades such as large concrete blocks to prevent lateral vehicle encroachment. Traffic barrier end treatments often precede leading barricades so that vehicles heading toward the leading barricades impact and are arrested by the traffic barrier end treatments instead.

Unfortunately, traffic barrier end treatments introduce other hazards to the occupants of impacting vehicles and nearby vehicles. For example, many traffic barrier end treatments launch impacting vehicles into the air or redirect them into adjacent lanes. The traffic barrier end treatments also buckle and burst into several fragments, which may damage nearby vehicles and harm their occupants.

Furthermore, some traffic barrier systems are moveable by barrier transfer machines (BTM) to create temporary barriers or to reconfigure the lanes. Many traffic barrier end treatments are not compatible with BTMs, while BTM-compatible traffic barrier end treatments have limited impact mitigation performance.

SUMMARY

Embodiments of the invention solve the above-mentioned problems and other problems and provide a distinct advance in the art of traffic barrier end treatments. More particularly, the invention provides an anchorless crash cushion apparatus with an improved nose assembly and crash and hinge plate assemblies that prevent an impacting vehicle from lifting off the ground, minimizes fragmentation, and is compatible with BTMs without compromise to impact mitigation performance.

An embodiment of the anchorless crash cushion apparatus broadly comprises a transition component, a number of crash cushion elements, a number of stabilizing members, a number of hinge plate assemblies, and a nose assembly. Elements of the anchorless crash cushion apparatus are configured to lift upwards when the anchorless crash cushion apparatus is impacted by a vehicle so that a center of gravity of the anchorless crash cushion apparatus remains above a center of gravity of the vehicle.

The transition component pivotably connects the anchorless crash cushion apparatus to a traffic divider. The transition component is similar to other hinge components described herein for allowing the anchorless crash cushion apparatus and the traffic divider to be fed through a BTM.

The crash cushion elements are positioned in-line with each other and are substantially identical to each other and thus only a first (forward-most) crash cushion element will be described in detail. The first crash cushion element includes a forward end, a rearward end, left and right stabilizer indentations, and left and right BTM indentations. The first crash cushion element is empty (i.e., filled with air, while subsequent crash cushion elements are filled with water, sand, or other energy-absorbing material.

The left and right stabilizer indentations extend longitudinally along sides of the first crash cushion element and include upper and lower stabilizer indentations. The left and right stabilizer indentations receive stabilizing members therein.

The left and right BTM indentations extend longitudinally along sides of the first crash cushion element and are configured to receive and guide rollers or other components of the BTM. The left and right BTM indentations are configured to align with BTM indentations of other crash cushion elements and the nose assembly so that the anchorless crash cushion apparatus can be fed through the BTM.

The stabilizing members extend longitudinally between the forward end and rearward end of the first crash cushion element in the left and right stabilizer indentations. The stabilizing members are configured to stabilize the crash cushion element, help keep crash cushion elements aligned and together during and after an impact event, and reduce an amount of debris and debris range due to the impact event.

The hinge plate assemblies support the crash cushion elements and connect the crash cushion elements together end-to-end. The hinge plate assemblies are substantially similar and thus only the first (forward-most) hinge plate assembly will be described in detail. The first hinge plate assembly includes a forward structure, a rearward structure, and a wedge incline.

The forward structure supports a front end of the first crash cushion element and includes a forward hinge component and an incline surface defining an incline recess. The forward structure is positively attached to the forward end of the corresponding crash cushion element.

The forward hinge component pivotably connects the hinge plate assembly to the nose assembly. Importantly, the forward hinge component is configured to move upward relative to the nose assembly so that the hinge plate assembly can be driven upward during an impact event. The forward hinge component is connected to corresponding hinge components via a pin or similar component.

The incline surface is configured to engage a wedge incline of the nose assembly (described in more detail below). The incline surface forms an incline recess for accommodating the wedge incline of the nose assembly.

The rearward structure includes a rearward hinge component and an incline surface defining an incline recess. The rearward structure is positively attached to the rearward end of the corresponding crash cushion element.

The rearward hinge component pivotably connects the hinge plate assembly to a subsequent (i.e., aft adjacent) hinge plate assembly. Importantly, the rearward hinge component is configured to move downward relative to the corresponding hinge component of the subsequent hinge plate assembly so that the subsequent hinge plate assembly can be driven upward relative to the hinge plate assembly.

The incline surface is configured to engage the wedge incline of the corresponding hinge plate assembly as the first crash cushion element collapses. The incline surface forms an incline recess for accommodating the wedge incline of the corresponding hinge plate assembly.

The wedge incline includes left and right angled sides and defines an incline recess. The wedge incline extends diagonally upward toward the forward structure.

The nose assembly includes a forward component and a rearward component. The nose assembly is configured to engage a vehicle and transfer impact forces to the crash cushion elements.

The forward component includes a vertical section, and a wedge incline. The forward component is the forwardmost element of the anchorless crash cushion apparatus and hence is configured to be contacted by a vehicle head-on.

The vertical section includes a lower protrusion, an upper protrusion, and left and right BTM indentations. The lower protrusion and upper protrusion are configured to vertically bracket the front of the vehicle to ensure the vehicle remains in engagement with the nose assembly and hence the anchorless crash cushion apparatus through the duration of the impact event.

The left and right BTM indentations extend longitudinally along sides of the vertical section and are configured to receive and guide rollers or other components of the BTM. The left and right BTM indentations are configured to align with BTM indentations of the rearward component and the crash cushion elements so that the anchorless crash cushion apparatus can be fed through the BTM.

The wedge incline includes left and right rails. Alternatively, a wedge incline similar to the wedge inclines of the hinge plate assemblies may be used. In one embodiment, a lateral guide may be positioned above the wedge incline to maintain lateral alignment of the forward component and the rearward component.

The rearward component includes a rearward hinge component, left and right BTM indentations, and wedge cross members. The rearward component is configured to facilitate substantially rearward motion of the forward component and effect lifting motion to the crash cushion elements.

The rearward hinge component pivotably connects the nose assembly to a first one of the hinge plate assemblies. Importantly, the rearward hinge component is configured to stay grounded relative to the corresponding hinge component of the first hinge plate assembly. Said another way, the corresponding hinge component of the first one of the hinge plate assemblies can be driven upward relative to the nose assembly when the nose assembly is driven toward the hinge plate assemblies.

The left and right BTM indentations extend longitudinally along sides of the rearward component and are configured to receive and guide rollers or other components of the BTM. The left and right BTM indentations are configured to align with BTM indentations of the forward component of the nose assembly and the crash cushion elements so that the anchorless crash cushion apparatus can be fed through the BTM.

The wedge cross members extend laterally between sides of the rearward component. The wedge cross members are configured to engage the wedge incline of the forward component to lift the rearward component of the nose assembly.

The anchorless crash cushion apparatus arrests a vehicle impacting the forward component. The forward component vertically brackets the vehicle to prevent the vehicle from being catapulted above the anchorless crash cushion apparatus. The forward component is urged rearward, thereby driving the rearward component up the wedge incline of the forward component. The rearward component is in turn driven rearward toward a first one of the crash cushion elements. Upward movement of the rearward component does not disconnect the rearward component from the first crash cushion element. Rather, the first crash cushion element is driven upward via the wedge incline of the forward component.

The first crash cushion element (and subsequent crash cushion elements) collapses longitudinally from impact forces. This drives the forward structure and the wedge incline of the first hinge plate assembly toward the rearward hinge component of the first hinge plate assembly. The wedge incline of first hinge plate assembly thereby drives the rearward structure (and hence a rearward portion of the first crash cushion element) upward. Subsequent crash cushion elements may be driven upward in the same manner.

The anchorless crash cushion apparatus provides several advantages. For example, when impacted by a vehicle, the nose assembly elevates its rearward component and the first one of the crash cushion elements while the forward component of the nose assembly remains in contact with the ground/road surface. Similarly, the wedge inclines of the crash cushion elements elevate subsequent crash cushion elements. This keeps the impacting vehicle from being catapulted or lifted off the ground/road surface.

The anchorless crash cushion apparatus is also compatible with a BTM. Specifically, the nose assembly and the crash cushion elements are pivotably connected via hinges and include left and right BTM indentations for engaging rollers of the BTM.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figure 1:
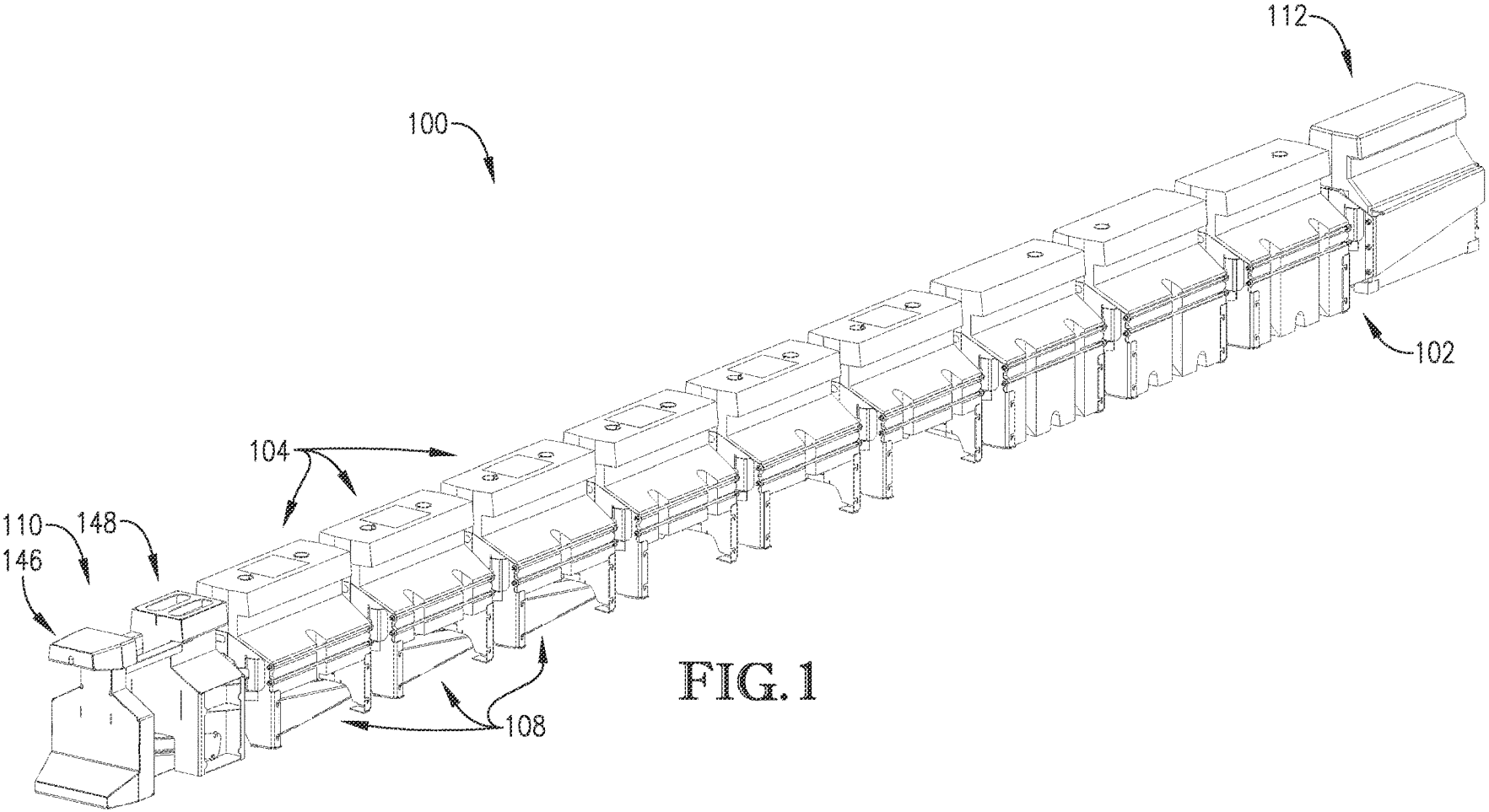
FIG. 1 is a perspective view of an anchorless crash cushion apparatus constructed in accordance with an embodiment of the invention.
Figure 2:
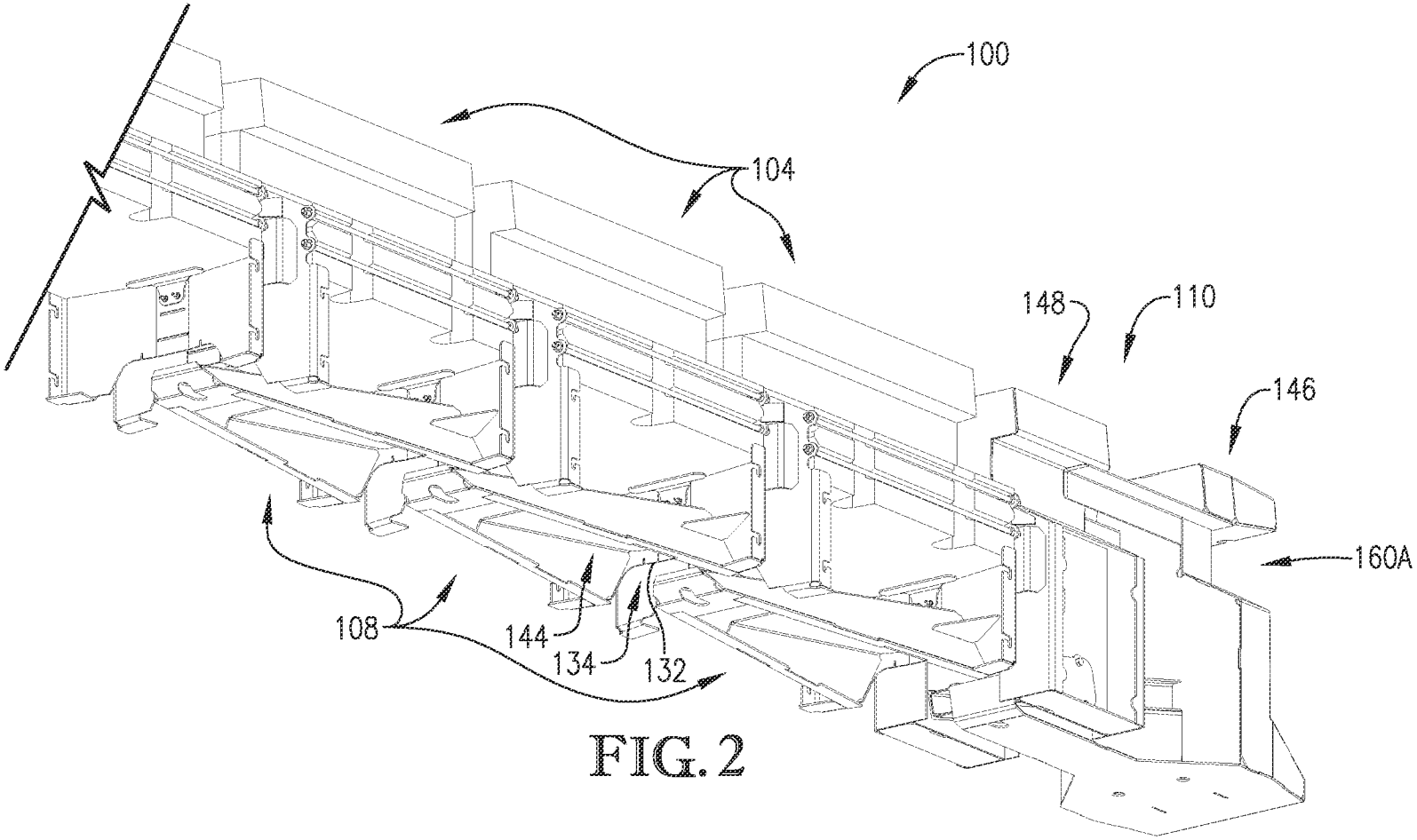
FIG. 2 is a bottom perspective view of the anchorless crash cushion apparatus of FIG. 1.
Figure 3A:
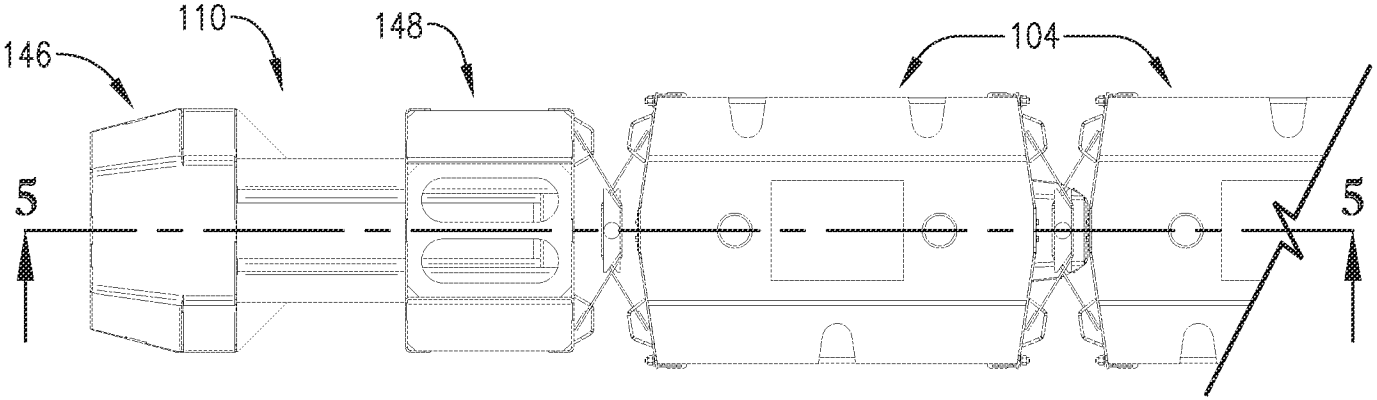
Figure 3B:
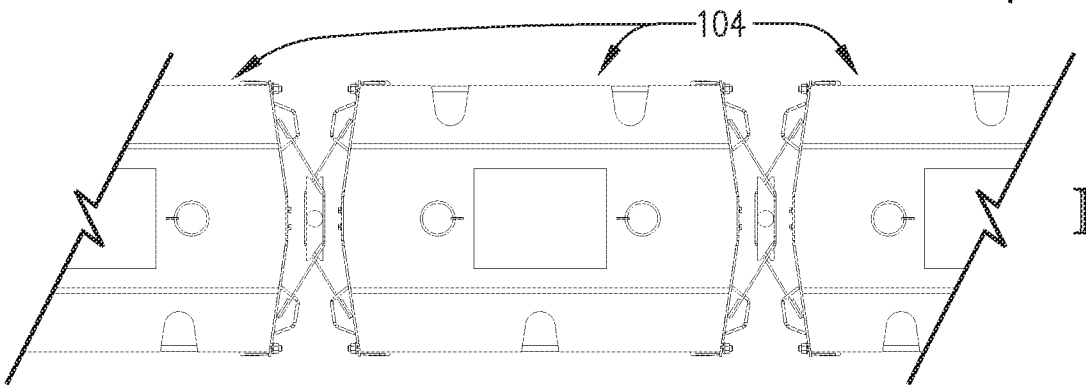
Figure 3C:
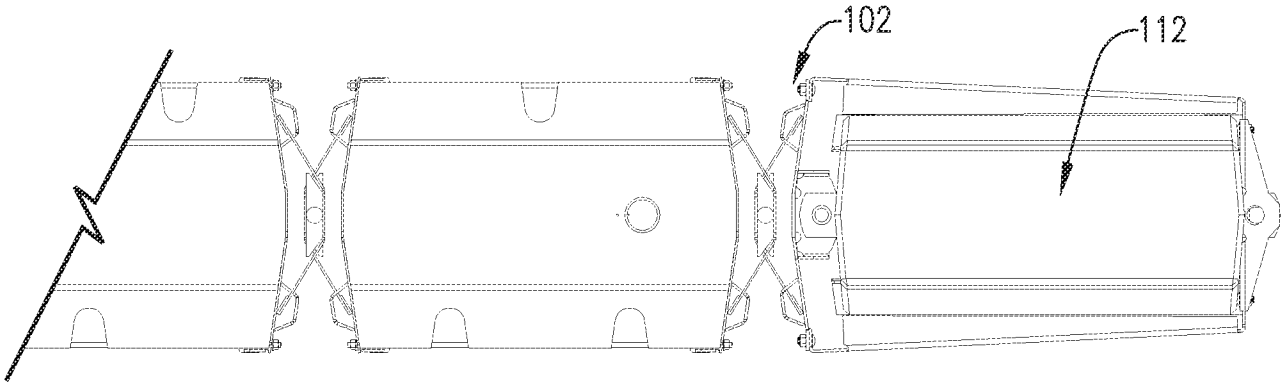
Figure 4:
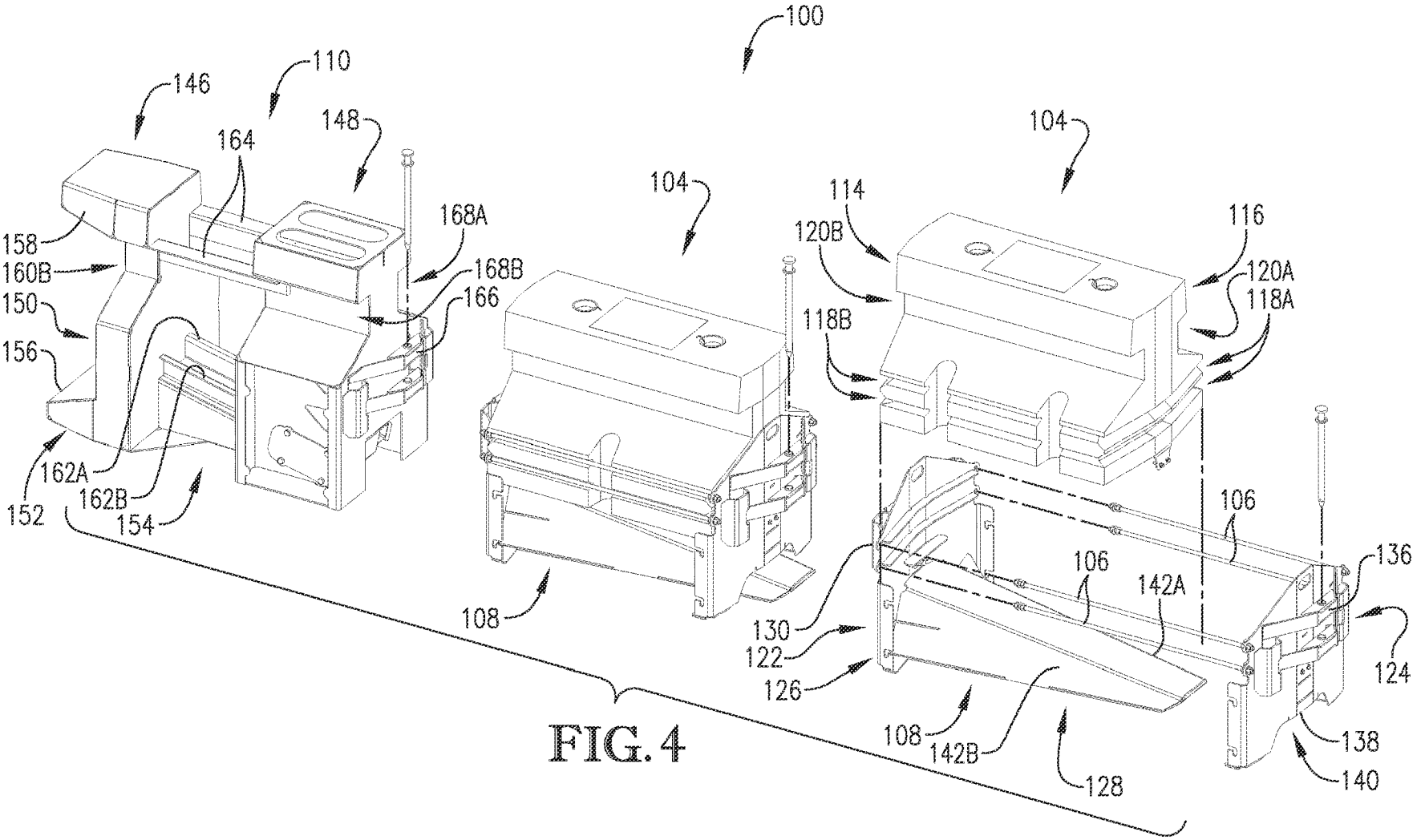
Figure 5:
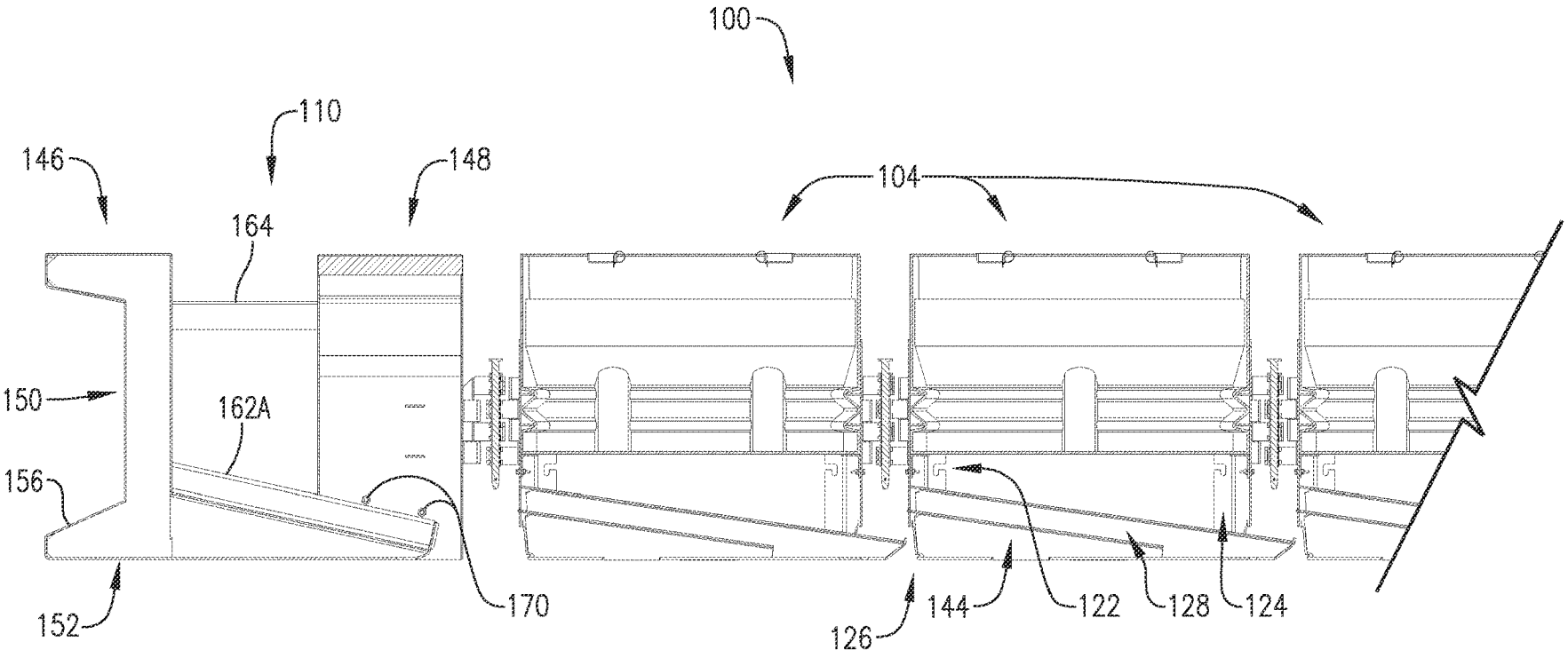
Figure 6:
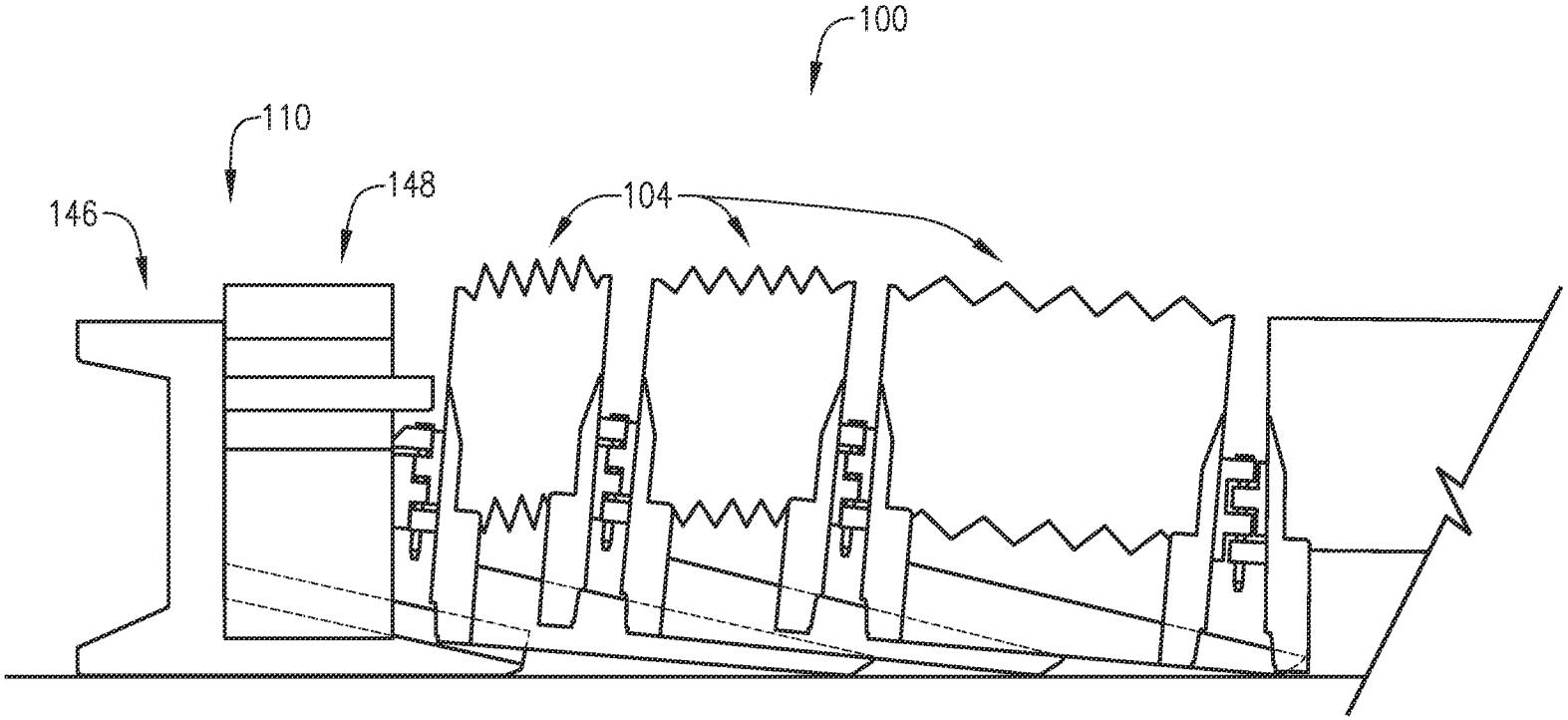

FIG. 3*a* is a plan view of a portion of the anchorless crash cushion apparatus of FIG. 1;

FIG. 3*b* is a plan view of another portion of the anchorless crash cushion apparatus of FIG. 1;

FIG. 3*c* is a plan view of another portion of the anchorless crash cushion apparatus of FIG. 1;

FIG. 4 is an exploded perspective view of certain components of the anchorless crash cushion apparatus of FIG. 1;

FIG. 5 is a cutaway elevation view of certain components of the anchorless crash cushion apparatus of FIG. 1; and FIG. 6 is a side elevation view of the anchorless crash cushion apparatus of FIG. 1 in an impacted state.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. As used in the specification and in the claims, ordering words such as "first" and "second" are used to distinguish between similar components and do not imply specific components. Thus, the current technology can include a variety of combinations and/or integrations of the embodiments described herein.

Turning to the drawing figures, an anchorless crash cushion apparatus 100 constructed in accordance with an embodiment of the invention is illustrated. The anchorless crash cushion apparatus 100 broadly comprises a transition component 102, a plurality of crash cushion elements 104, a plurality of stabilizing members 106, a plurality of hinge plate assemblies 108, and a nose assembly 110.

The transition component 102 pivotably connects the anchorless crash cushion apparatus 100 to a traffic divider 112. The transition component 102 may be similar to other hinge components described herein for allowing the anchorless crash cushion apparatus 100 and the traffic divider 112 to be fed through a BTM.

The plurality of crash cushion elements 104 may be positioned inline with each other and may be substantially identical to each other. In some embodiments, several crash cushion elements 104 near the nose assembly 110 may have truncated lower ends, while several crash cushion elements 104 near the transition component 102 may have a relatively fuller volume, as seen in FIG. 1. Each crash cushion element 104 includes a forward end 114, a rearward end 116, left and right stabilizer indentations 118A,B, and left and right BTM indentations 120A,B. The plurality of crash cushion elements 104 may be rigid or semi-rigid containers configured to enclose a liquid, sand, air, or the like. To that end, one or more of the crash cushion elements 104 near the nose assembly 110 may be empty (i.e., full of air) while several of the crash cushion elements 104 aft of the air-filled crash cushion element(s) 104 may be filled with water, sand, or the like.

The left and right stabilizer indentations 118A,B extend longitudinally along sides of the crash cushion element 104 and may include an upper stabilizer indentation and a lower stabilizer indentation (so that there are two stabilizer indentations on each side of the crash cushion element 104). The left and right stabilizer indentations 118A,B receive stabilizing members 106 therein.

The left and right BTM indentations 120A,B extend longitudinally along sides of the crash cushion element 104 and are configured to receive and guide rollers or other components of the BTM. The left and right BTM indentations 120A, B are configured to align with BTM indentations of other crash cushion elements and the nose assembly 110 so that the anchorless crash cushion apparatus 100 can be fed through the BTM.

The plurality of stabilizing members 106 extend longitudinally between the forward end 114 and rearward end 116 of the crash cushion element 104 in the left and right stabilizer indentations 118A,B. The plurality of stabilizing members 106 are configured to stabilize the crash cushion element 104, help keep crash cushion elements aligned and together during and after an impact event, and reduce an amount of debris and debris range due to the impact event.

The plurality of hinge plate assemblies 108 support the crash cushion elements 104 and connect the plurality of crash cushion elements 104 together end-to-end. The hinge plate assemblies 108 are substantially similar and thus the forward-most hinge plate assembly 108 will be described in detail. The hinge plate assembly 108 includes a forward structure 122, a rearward structure 124, and a wedge incline 128.

The forward structure 122 supports a front end of the corresponding crash cushion element 104 and may include a forward hinge component 130 and a complementary incline surface 132 defining an incline recess 134. The forward structure 122 may be positively attached to the forward end 114 of the corresponding crash cushion element 104 via fasteners, interlocking geometry, or the like, or may cradle or bracket the corresponding crash cushion element 104 via a friction fit, approximate fit, or the like.

The forward hinge component 130 pivotably connects the hinge plate assembly 108 to the nose assembly 110 (or to a preceding hinge plate assembly). Importantly, the forward hinge component 130 may be configured to move upward relative to the noise assembly 110 (or a hinge component of a preceding hinge plate assembly) so that the hinge plate assembly 108 can be driven upward during an impact event. The forward hinge component 130 (and other hinge components) may be connected to corresponding hinge components via a pin or similar component.

The incline surface 132 may be configured to engage a wedge incline of the nose assembly 110 (described in more detail below) or a wedge incline of a preceding (i.e., forward adjacent) hinge plate assembly. The incline surface 132 may form an incline recess 134 for accommodating the preceding wedge incline. Other structures such as a cross-beam could be used in place of the incline surface 132.

The rearward structure 124 may include a rearward hinge component 136 and an incline surface 138 defining an incline recess 140. The rearward structure 124 may be positively attached to the rearward end 116 of the corresponding crash cushion element 104 via fasteners, interlocking geometry, or the like, or may cradle or bracket the corresponding crash cushion element 104 via a friction fit, approximate fit, or the like.

The rearward hinge component 136 pivotably connects the hinge plate assembly 108 to a subsequent (i.e., aft adjacent) hinge plate assembly. Importantly, the rearward hinge component 136 may be configured to move downward relative to the corresponding hinge component of the subsequent hinge plate assembly so that the subsequent hinge plate assembly can be driven upward relative to the hinge plate assembly 108 when the hinge plate assembly 108 is driven toward the subsequent hinge plate assembly.

The incline surface 138 may be configured to engage the wedge incline 128 of the corresponding hinge plate assembly 108 as the corresponding crash cushion element 104 collapses. The incline surface 138 may form an incline recess 140 for accommodating the wedge incline 128 of the corresponding hinge plate assembly 108. Other structures such as a cross-beam could be used in place of the incline surface 138.

The wedge incline 128 may include left and right angled sides 142A,B and defines an incline recess 144. The wedge incline 128 extends diagonally upward toward the forward structure 122. The left and right angled sides 142A, B may be shaped to fit in incline recesses of a subsequent hinge plate assembly. As a related matter, the incline recess 144 may be configured to receive a wedge incline of a preceding hinge plate assembly. The wedge incline 128 may be substantially triangular when viewed from the side.

The nose assembly 110 may include a forward component 146 and a rearward component 148. The nose assembly 110 is configured to engage a vehicle and transfer impact forces to the crash cushion elements 104.

The forward component 146 may include a vertical section 150, and a wedge incline 154. The forward component 146 is the forwardmost element of the anchorless crash cushion apparatus 100 and hence is configured to be contacted by a vehicle head-on. The forward component 146 may be made of metal or any other suitable material.

The vertical section 150 may include a lower protrusion 156, an upper protrusion 158, and left and right BTM indentations 160A,B. The lower protrusion 156 and upper protrusion 158 may be configured to vertically bracket the front of the vehicle to ensure the vehicle remains in engagement with the nose assembly 110 and hence the anchorless crash cushion apparatus 100 through the duration of the impact event.

The left and right BTM indentations 160A,B extend longitudinally along sides of the vertical section 150 and are configured to receive and guide rollers or other components of the BTM. The left and right BTM indentations 160A, B are configured to align with BTM indentations of the rearward component 148 and the crash cushion elements 104 so that the anchorless crash cushion apparatus 100 can be fed through the BTM.

The wedge incline 154 may include left and right rails 162A, B. Alternatively, a wedge incline similar to the wedge inclines of the hinge plate assemblies 108 may be used. In one embodiment, a lateral guide 164 may be positioned above the wedge incline 154 to maintain lateral alignment of the forward component 146 and the rearward component 148.

The rearward component 148 may include a rearward hinge component 166, left and right BTM indentations 168A,B, and wedge cross members 170. The rearward component 148 may be configured to facilitate substantially rearward motion of the forward component 146 and effect lifting motion to the crash cushion elements 104.

The rearward hinge component 166 pivotably connects the nose assembly 110 to a first one of the hinge plate assemblies 108. Importantly, the rearward hinge component 166 may be configured to stay grounded relative to the corresponding hinge component of the first one of the hinge plate assemblies 108. Said another way, the corresponding hinge component of the first one of the hinge plate assemblies 108 can be driven upward relative to the nose assembly 110 when the nose assembly 110 is driven toward the hinge plate assemblies 108.

The left and right BTM indentations 168A,B extend longitudinally along sides of the rearward component 148 and are configured to receive and guide rollers or other components of the BTM. The left and right BTM indentations 168A, B are configured to align with BTM indentations of the forward component 146 and the crash cushion elements 104 so that the anchorless crash cushion apparatus 100 can be fed through the BTM.

The wedge cross members 170 extend laterally between sides of the rearward component 148 and may be configured to engage the wedge incline 154 of the forward component 146, as seen in FIG. 5. The wedge cross members 170 are shown as rods diagonally offset from each other at an equivalent angle of the wedge incline 154 of the forward component 146 so that the rearward component 148 remains substantially upright. Alternatively, an inverted, complementary wedge incline may be used.

Turning to FIG. 6, the anchorless crash cushion apparatus 100 arrests a vehicle (not shown) impacting the forward component 146. Specifically, the forward component 146 vertically brackets the vehicle to prevent the vehicle from being catapulted above the anchorless crash cushion apparatus 100. As seen in FIG. 6, the forward component 146 is urged rearward, thereby driving the rearward component 148 up the wedge incline 154 of the forward component 146. The rearward component 148 is in turn driven rearward toward a first one of the crash cushion elements 104. Upward movement of the rearward component 148 does not disconnect the rearward component 148 from the first crash cushion element 104. Rather, the first crash cushion element 104 may be driven upward via the wedge incline 154 of the forward component 146.

The first crash cushion element 104 may collapse longitudinally from impact forces. This drives the forward structure 122 and the wedge incline 128 of the corresponding hinge plate assembly 108 toward the rearward hinge component 136 of the corresponding hinge plate assembly 108. The wedge incline 128 of the corresponding hinge plate assembly 108 thereby drives the rearward structure 124 (and hence a rearward portion of the first crash cushion element 104) upward. Subsequent crash cushion elements may be driven upward in the same manner.

The anchorless crash cushion apparatus 100 provides several advantages. For example, when impacted by a vehicle, the nose assembly 110 elevates its rearward component 148 and the first one of the crash cushion elements 104 while the forward component 146 of the nose assembly 110 remains in contact with the ground/road surface, as seen in FIG. 6. Similarly, the wedge inclines 128 of the crash cushion elements 104 elevate subsequent crash cushion elements 104. This keeps the impacting vehicle from being catapulted or lifted off the ground/road surface.

The anchorless crash cushion apparatus 100 may also be compatible with a BTM. Specifically, the nose assembly 110 and the crash cushion elements 104 are pivotably connected via hinges and include left and right BTM indentations for engaging rollers of the BTM.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A nose assembly for an anchorless crash cushion apparatus, the nose assembly comprising:

a forward component comprising:

an forward section configured to engage the vehicle; and a wedge incline extending diagonally upward toward the forward section; and a rearward component configured to be driven upward by the wedge incline when the forward component is driven toward the rearward component by the vehicle.

2. The nose assembly of claim 1, the rearward component including a complementary structure configured to be engaged by the wedge incline of the forward component.

3. The nose assembly of claim 2, the wedge incline of the forward component and the complementary structure being set at equivalent angles.

4. The nose assembly of claim 2, the complementary structure being a rail.

5. The nose assembly of claim 2, the complementary structure being offset cross-members.

6. The nose assembly of claim 1, the forward component being made of metal, the rearward component being made of a plastic material.

7. The nose assembly of claim 1, the forward section further comprising a lower protrusion and an upper protrusion configured to vertically bracket the vehicle to retain the vehicle in engagement with the vertical section.

8. The nose assembly of claim 1, the anchorless crash cushion apparatus being compatible with a barrier transfer machine, the forward component and the rearward component each having left and right indentations for being engaged by the barrier transfer machine.

9. The nose assembly of claim 1, the anchorless crash cushion apparatus including a crash cushion element, the rearward component including a hinge component for connecting the rearward component to the crash cushion element.

10. The nose assembly of claim 1, the wedge incline further comprising a lateral guide configured to laterally retain the rearward component on the forward component.

11. An anchorless crash cushion apparatus comprising:
- a plurality of crash cushion elements configured to be directly or indirectly connected end-to-end; and
- a nose assembly configured to be connected to one of the plurality of crash cushion elements, the nose assembly comprising:
  - a forward component comprising:
    - a forward section configured to engage the vehicle; and
    - a wedge incline extending diagonally upward toward the forward section; and
  - a rearward component configured to be driven upward by the wedge incline when the forward component is driven toward the rearward component by the vehicle.

12. The anchorless crash cushion apparatus of claim 11, the rearward component including a complementary structure configured to be engaged by the wedge incline of the forward component.

13. The anchorless crash cushion apparatus of claim 12, the wedge incline of the forward component and the complementary structure being set at equivalent angles.

14. The anchorless crash cushion apparatus of claim 12, the complementary structure being a rail.

15. The anchorless crash cushion apparatus of claim 12, the complementary structure being offset cross-members.

16. The anchorless crash cushion apparatus of claim 11, the forward component being made of metal, the rearward component being made of a plastic material.

17. The anchorless crash cushion apparatus of claim 11, the forward component further comprising a lower protrusion and an upper protrusion configured to vertically bracket the vehicle to retain the vehicle in engagement with the vertical section.

18. The anchorless crash cushion apparatus of claim 11, the anchorless crash cushion apparatus being compatible with a barrier transfer machine, the plurality of crash cushion elements, the forward component, and the rearward component each having left and right indentations for being engaged by the barrier transfer machine.

19. The anchorless crash cushion apparatus of claim 11, the wedge incline further comprising a lateral guide configured to laterally retain the rearward component on the forward component.

20. An anchorless crash cushion apparatus comprising:
- a plurality of crash cushion elements configured to be directly or indirectly connected end-to-end; and
- a nose assembly configured to be connected to one of the plurality of crash cushion elements, the nose assembly comprising:
  - a forward component comprising:
    - a forward section configured to engage the vehicle, the forward section including opposing upper and lower protrusions configured to bracket the vehicle;
    - a wedge incline extending diagonally upward toward the forward section;
    - opposing left and right recesses configured to receive rollers of a barrier transfer machine; and
  - a rearward component comprising:
    - offset cross-members configured to slide up the wedge incline so that the rearward component is configured to be driven upward by the wedge incline when the forward component is driven toward the rearward component by the vehicle; and
    - opposing left and right recesses configured to receive the rollers of the barrier transfer machine, the opposing left and right recesses of the forward component and the opposing left and right recesses of the rearward component being configured to be aligned with each other.

* * * * *